US005202524A

United States Patent [19]

Nechushtan

[11] Patent Number: 5,202,524

[45] Date of Patent: Apr. 13, 1993

[54] GUN AND METHOD OF MOUNTING A SIGHT THEREON

[75] Inventor: Aharon Nechushtan, Kibbutz Hagoshrim, Israel

[73] Assignee: Scopus Light (1990) Ltd., Kibbutz Maayan Zvi, Israel

[21] Appl. No.: 727,073

[22] Filed: Jul. 9, 1991

[51] Int. Cl.[5] ..... F41G 1/02

[52] U.S. Cl. ..... 42/100; 33/233; 33/241; 29/1.1; 29/513

[58] Field of Search ..... 42/100; 29/1.1, 513; 33/233, 241

[56] References Cited

U.S. PATENT DOCUMENTS 217,717 7/1979 Warfield ..... 33/233

1,656,856 1/1928 Gagnon ..... 29/513

1,695,440 12/1928 Redfield ..... 29/1.1

2,246,174 6/1941 Howells ..... 33/241

*Primary Examiner*—Michael J. Carone

*Attorney, Agent, or Firm*—Ladas & Parry

[57] ABSTRACT

A gun including a main body including a barrel and defining an opening, and a sight mounted onto the main body, wherein the sight includes a top portion protruding externally of the main body; and base apparatus rigidly connected to and extending from the top portion and into an opening arranged in the main body, the base apparatus including a non-threaded portion in peripherally fixed engagement with adjacent portions of the main body, so as to rigidly connect the base apparatus thereto.

11 Claims, 6 Drawing Sheets

GUN AND METHOD OF MOUNTING A SIGHT THEREON

FIELD OF THE INVENTION

The present invention relates, in general, to gunsights, and, in particular, to methods of fastening and aligning gunsights.

BACKGROUND OF THE INVENTION

A handgun normally has front and rear sights fastened thereto via its slide. In some instances, the front sight is an integral part of the slide. More commonly, however, the front sight is fastened to the slide by one of a number of methods, such as by mating dovetails, screws or tenons.

Among disadvantages inherent in the fastening of gunsights by screws, are the following:

the screw constitutes a separate component to be manufactured and handled, together with the accompanying expenses;

assembling of a screw-fastened gunsight may be a lengthy and cumbersome operation because of the need to orient the pieces, hold them in a predetermined position for assembly, and then tighten the screw;

screws, when used in environments subject to high mechanical stresses, eventually become loose; and as both the sight and the gun slide have dimensional tolerances to allow for production and assembly techniques, there exits a certain amount of freedom between the two parts, once assembled. This freedom cannot be eliminated by tightening the screw, and manifests itself as a minor misalignment of the sight relative to the gun.

Among handguns having a front sight fastened by use of tenons is the Colt ( TM ). In particular, the front sight is attached to the slide via a metal tenon (leg) which extends from the base of the sight, and through an opening in the slide. The metal tenon is flattened so as to secure the sight in a fixed position relative to the slide. As the tenon is a solid piece of metal with various inherent internal stresses and a unique, unknown grain structure, the flattening is not fully controllable and is not uniform and may thus result in misalignment of the sight.

SUMMARY OF THE INVENTION

The present invention seeks to provide an improved method of permanently affixing a sight to a gun, so as to overcome disadvantages of known art.

The present invention further seeks to provide a gun having a sight accurately and immovably mounted thereon, so as to overcome disadvantages of known art.

There is provided, therefore, in accordance with an embodiment of the invention, a gun including a main body including a barrel and defining an opening, and a sight mounted onto the main body, wherein the sight includes a top portion protruding externally of the main body; and base apparatus rigidly connected to and extending from the top portion and into an opening arranged in the main body, the base apparatus including a non-threaded portion in peripherally fixed engagement with adjacent portions of the main body, so as to rigidly connect the base apparatus thereto.

Additionally in accordance with an embodiment of the invention, the base apparatus has an external configuration that is similar to that of the opening, the non-threaded portion is a side wall portion surrounding a central portion of a free end of the base apparatus, and the side wall portion defines a peripheral portion extending outwardly from the recessed portion so as to tightly engage surfaces of the main body adjacent to the base apparatus.

Further in accordance with an embodiment of the invention, the side wall portion extends through the opening so as to protrude beyond an inward-facing surface of the main body, and the peripheral portion extending outwardly is a flared portion of the side wall, the flared portion being configured to tightly engage the opening and the inward-facing surface of the main body.

Additionally in accordance with an embodiment of the invention, the opening is a slot having a longitudinal axis generally parallel to the longitudinal axis of the barrel, and the top portion of the sight defines a rearward facing front planar surface and an optical axis extending transversely thereto and in generally coplanar registration with the longitudinal axis of the barrel.

Further in accordance with an embodiment of the invention, the gun is a handgun and the main body also includes a slide, the sight being a front sight secured to the main body via an opening arranged in the slide.

Additionally in accordance with an embodiment of the invention, the opening is a slot having a longitudinal axis parallel to the longitudinal axis of symmetry of the slide and generally parallel to the longitudinal axis of the barrel.

In accordance with a further embodiment of the invention, there is provided, a method of fastening onto a gun having a barrel and further having, at a preselected location, an opening having a predetermined position relative to the longitudinal axis of the barrel, a sight having a top portion and a base having a side wall portion extending from the top portion, the method including the following steps:

inserting the base of the sight into the opening such that the top portion of the sight rests on an outward-facing surface of the gun and such that the base is arranged within the opening; and securing the sight to the gun by outwardly bending the side wall portion of the base such that peripheral portions of the side wall are fixedly engaged with surfaces of the gun adjacent thereto.

Additionally in accordance with an embodiment of the invention, the step of inserting includes inserting the base into the opening such that a free end defined by the base protrudes beyond an inward-facing surface of the gun, and, in the step of securing, the outward bending of the side wall portion causes tight engagement thereof with the opening and with the inward-facing surface of the gun.

Further in accordance with an embodiment of the invention, the top portion of the sight defines a rearward facing front planar surface and an optical axis extending transversely thereto, and the opening is a slot having a longitudinal axis parallel to the longitudinal axis of the barrel, the step of securing including the step of causing engagement of the sight with the gun in a predetermined position so as to position the optical axis of the top portion of the sight in generally coplanar registration with the longitudinal axis of the barrel.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
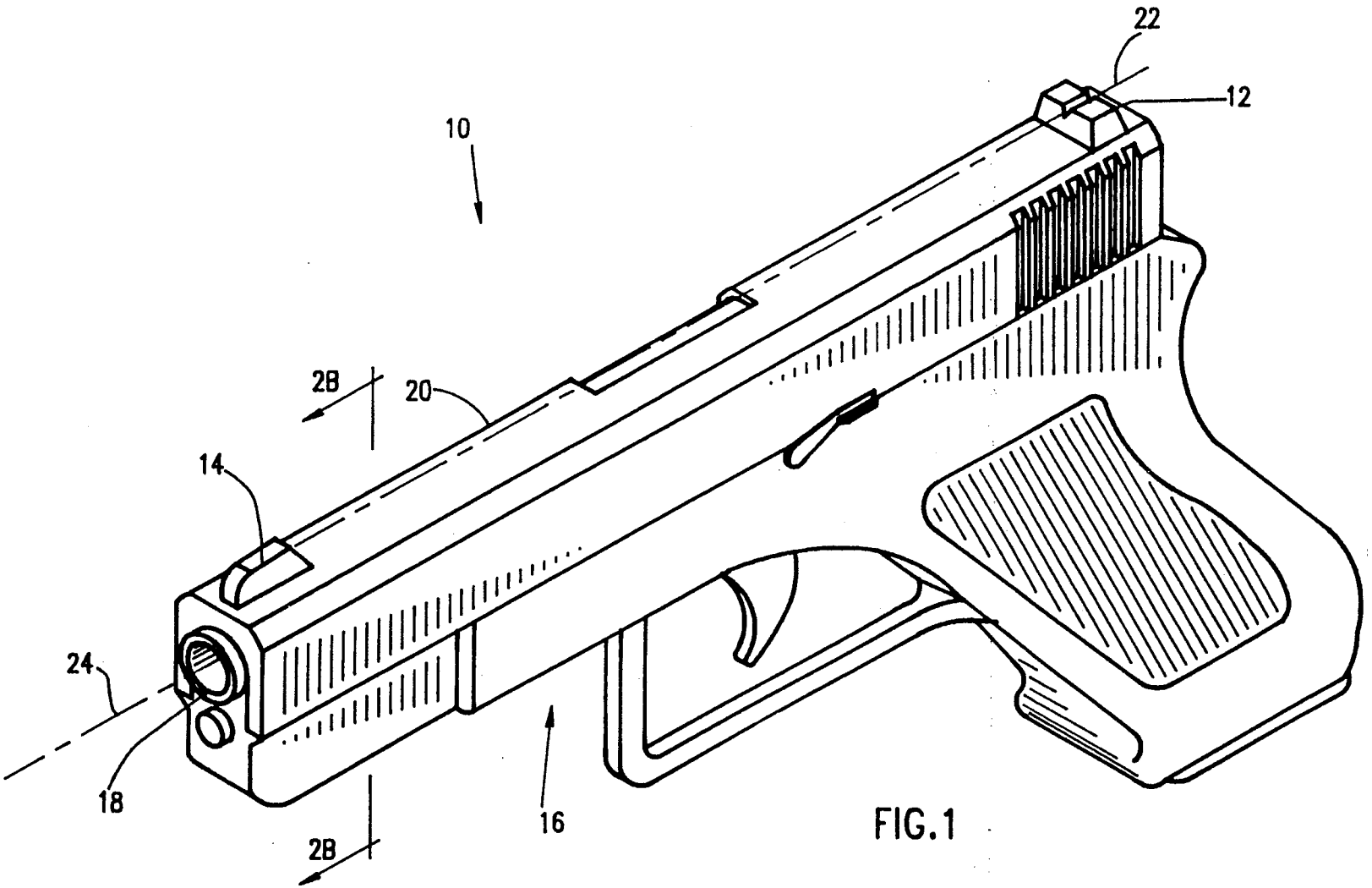
FIG. 1 is an isometric view of a gun on which a sight has been mounted in accordance with the present invention.

Referring now to FIG. 1, there is shown a gun, referenced generally 10, having a rear sight 12 and a front sight 14, mounted on gun 10 in accordance with the present invention. Gun 10 includes a main body, referenced generally 16, including a barrel 18 and a slide 20. Typically, although not necessarily, gun 10 is a handgun such as a semiautomatic pistol, manufactured by Glock (R) Inc., of Smyrna, Georgia 30081, U.S.A.

Figure 2A:
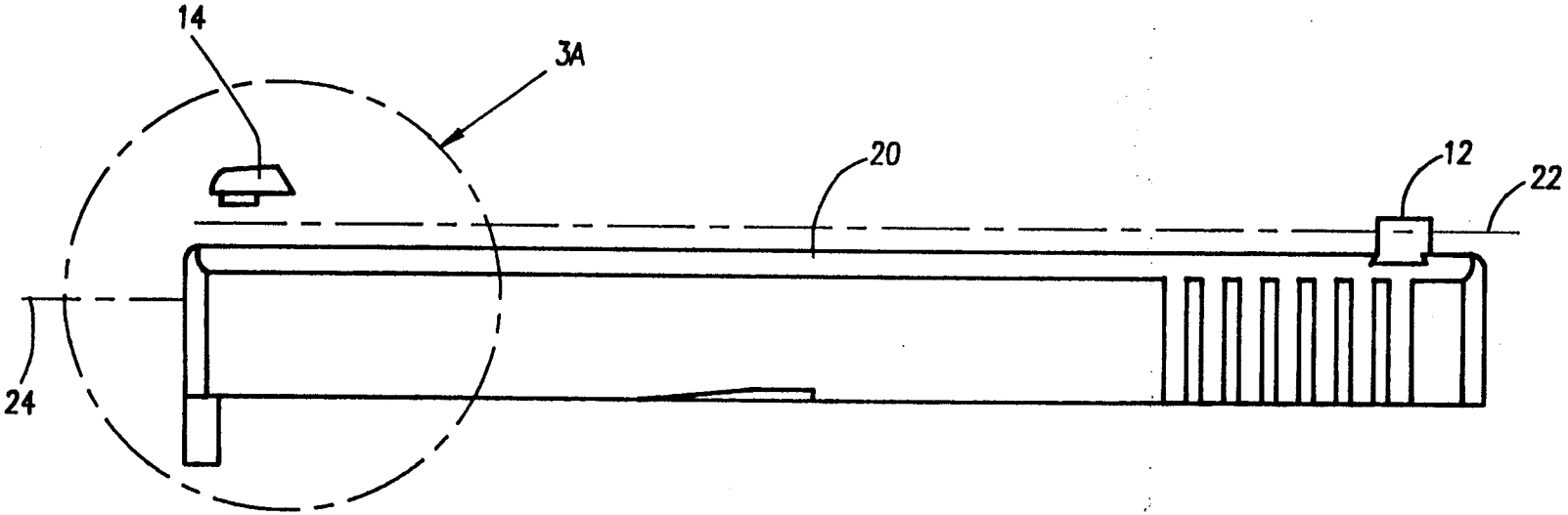
FIG. 2A is a side view of the slide and sights of the gun illustrated in FIG. 1, wherein the front sight is depicted in a position prior to being mounted onto the slide.

Referring now also to FIG. 2A, according to the illustrated example, sights 12 and 14 are mounted onto slide 20 so as to define an optical sighting axis 22. Sights 12 and 14 are mounted onto the slide 20 such that axis 22 is arranged in generally coplanar registration with a longitudinal axis 24 of barrel 18 (FIG. 1). Rear sight 12 is typically a conventional, fixed or adjustable sight, which, under normal conditions, and when the gun is positioned in a vertical plane in a firing position, is mounted so as to be in vertical registration with the barrel axis 24.

Figure 2B:
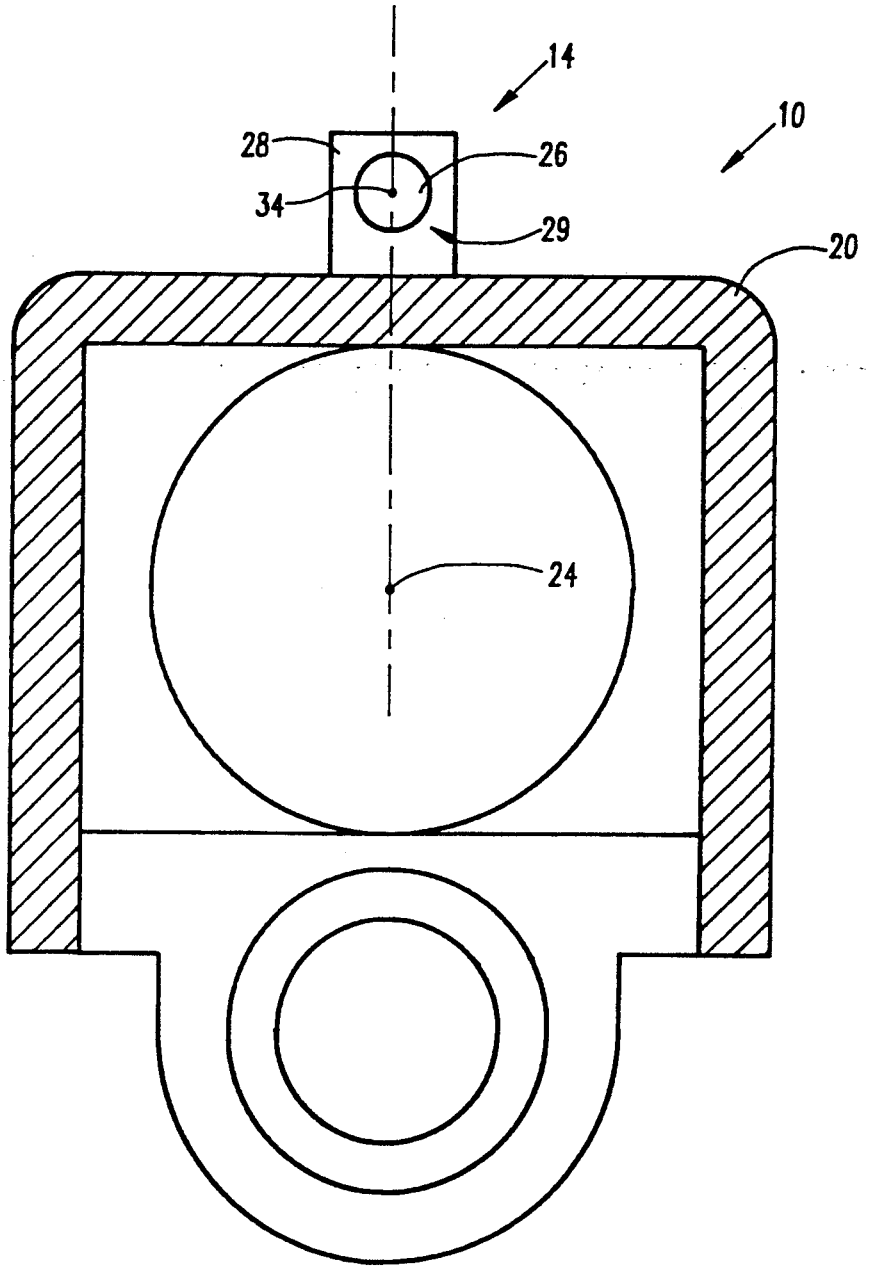
FIG. 2B is a cross-sectional view of the slide of the gun illustrated in FIG. 1, taken along the line 2B—2B therein.

Referring now also to FIG. 2B, front sight 14 is typically an illuminated sight, having a light source 26 such as a radioluminous light source. Sight 14 is constructed for mounting in accordance with the method described hereinbelow. Front sight 14 has a top portion 28 having a rearward facing front planar surface 29 and an optical axis 34 extending transversely thereto and in generally coplanar registration, that is, coplanar or near coplanar registration, with barrel axis 24. When front sight 14 is an illuminated sight, light source 26 thereof is arranged to coincide with optical axis 34.

Figure 3A:
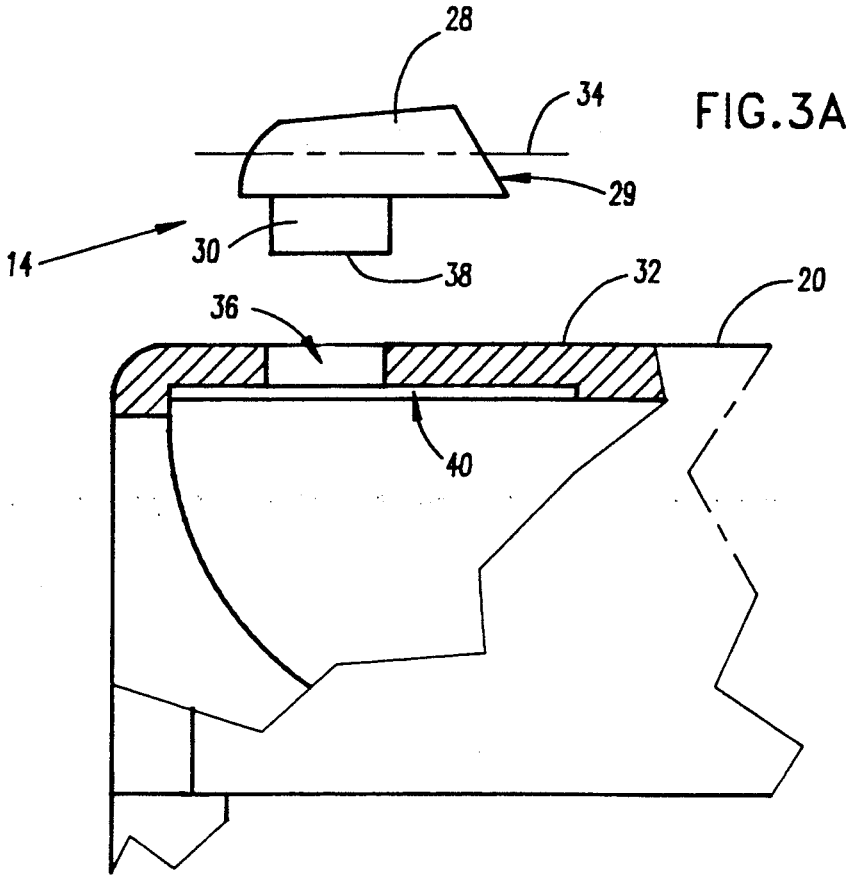
FIG. 3A is an enlarged, partially cut-away detailed view of the apparatus indicated by arrow 3A in FIG. 2A.
Figure 3B:
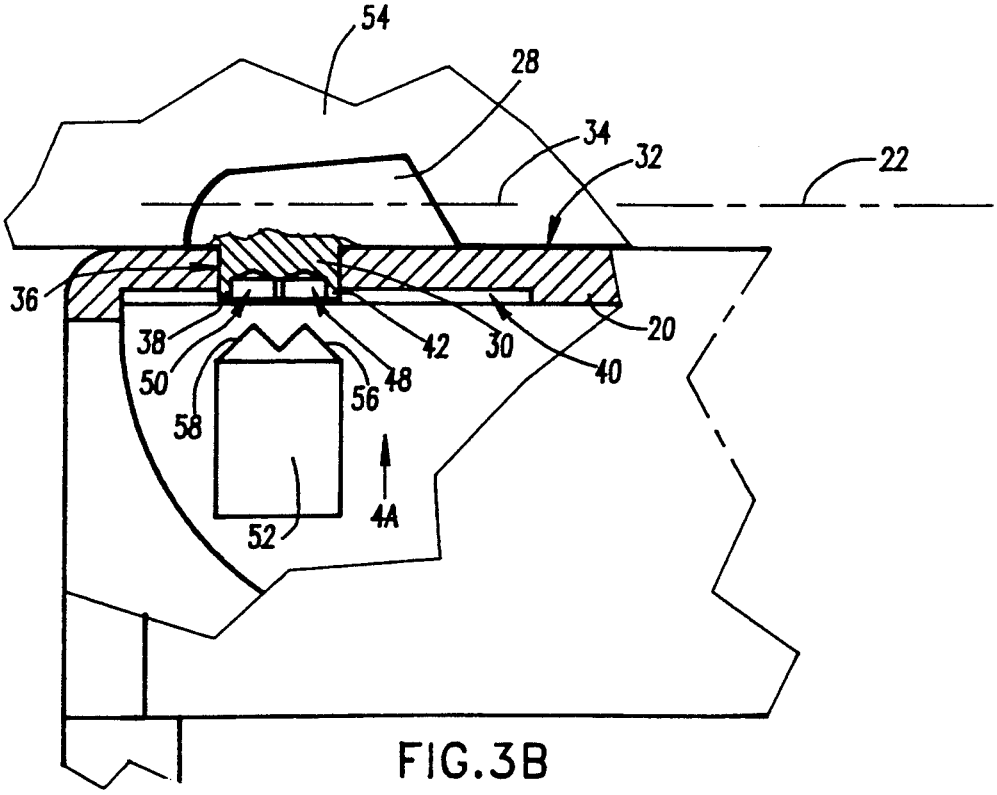
FIGS. 3B–3D are partially cut-away side views of the sight after insertion into the slide and showing various stages of fastening of the sight to the slide, in accordance with the method of the invention.
Figure 3C:
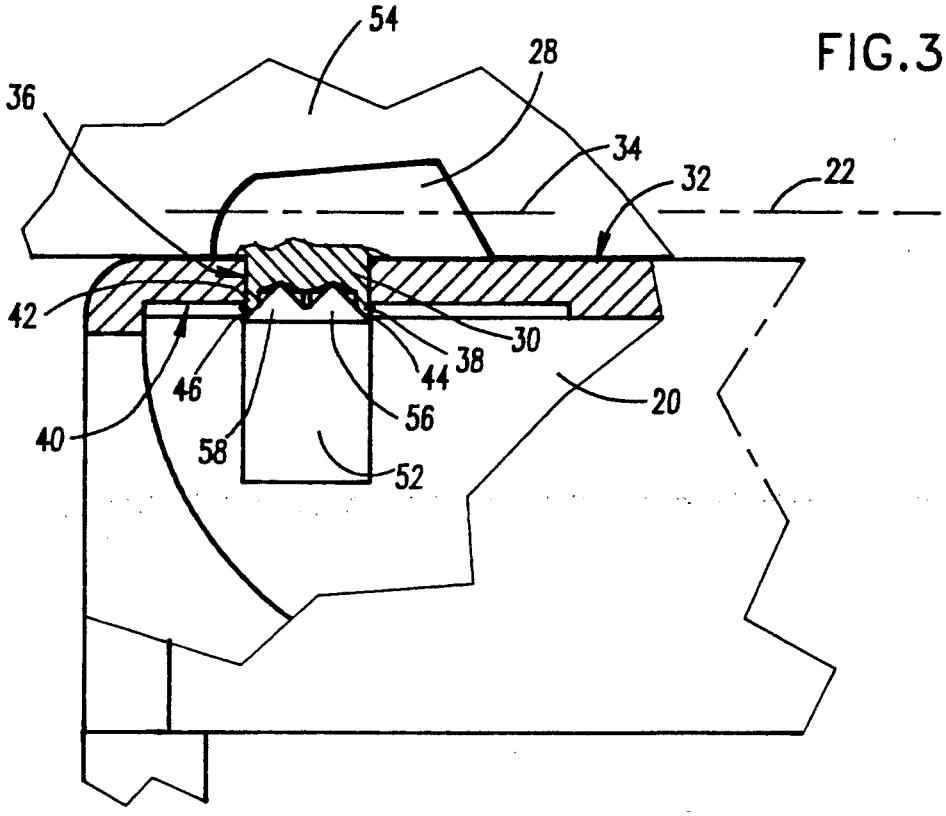
Figure 3D:
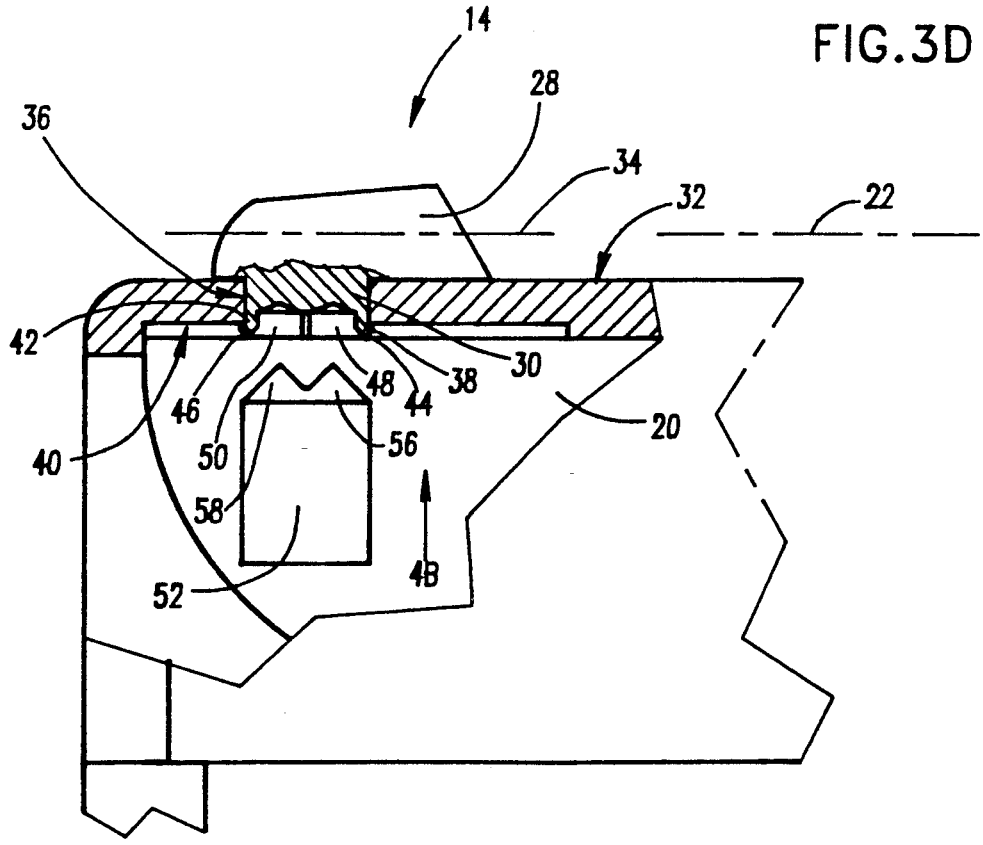

Referring now to FIGS. 3A–3D, front sight 14 has, in addition to top portion 28, a non-threaded base 30. When sight 14 is in a mounted position, as illustrated in FIGS. 3B–3D, top portion 28 protrudes above and rests on an upper surface 32 of slide 20. As described below, slide 20 and sight 14 are constructed such that, when sight 14 is fastened to slide 20, the optical sighting axis 22 coincides with optical axis 34, in generally coplanar registration with barrel axis 24.

Referring now particularly to FIGS. 3A–3D, front sight 14 is assembled with the remainder of the gun such that optical axis 34 is aligned with a degree of accuracy that surpasses conventional sights. The assembly process is substantially as described hereinbelow.

An initial step is that of forming, at a preselected mounting location on slide 20, an opening 36, preferably in the form of a slot, having a predetermined position relative to the longitudinal axis 24 of the barrel 18. The slot is configured to receive base 30 of sight 14. It is also envisaged that base 30 may be especially configured so as to match an existing 'generic' slot provided in slide 20.

The base 30 of the sight 14 is then inserted into slot 36, such that top portion 28 of sight 14 rests on upper surface 32 of the slide 20. According to the present embodiment, a free-end end portion 38 of non-threaded base 30 extends through slot 36 and protrudes, as illustrated in FIG. 3B, beyond lower surface 40 of slide 20.

Finally, sight 14 is secured to slide 20 by applying, as by suitable swaging apparatus described below, to a downwardly extending side wall 42 of base 30, a substantially uniform outward bending force. This uniform outward force causes the side wall 42 to be brought into fixed peripheral engagement with adjacent surfaces of the slide 20.

More particularly, application of the outward bending force causes the free-end portion 38 of side wall 42 of base 30 to become bent in opposing radial directions so as to define flared portions 44 and 46 which become tightly engaged with slot 36 and with the lower surface 40 of slide 20. It will be appreciated that, after the swaging has been completed, sight 14 is locked to the slide 20.

Figure 4A:
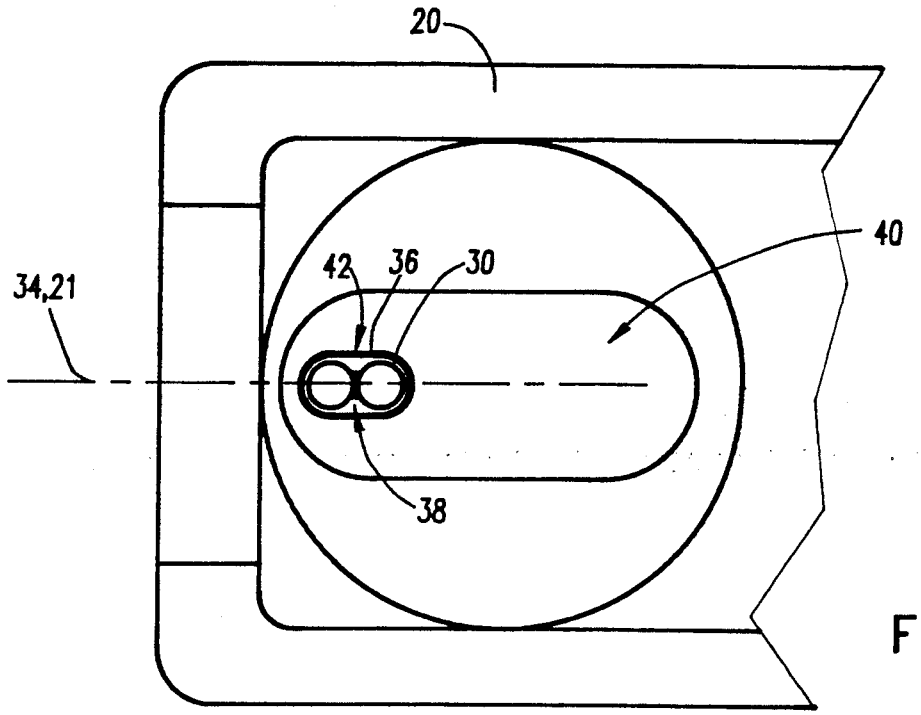
FIG. 4A is a bottom view illustration of the slide and sight of the invention, illustrating the configuration of the sight base prior to fastening, and taken in the direction of arrow 4A in FIG. 3B.

Swaging, as described hereinbelow, permits application of a uniformly, typically radial, outward force so as to cause a corresponding spreading of the free-end portion 38 of the base 30, thereby causing sight 14 to become virtually immovably centered with respect to slot 36, such that optical axis 34 is also fixed in a position that is generally parallel to the slot. As slot 36 is parallel to a longitudinal axis of symmetry 21 (FIGS. 4A and 4B) of slide 20, and as slide 20 is assembled with the remaining portions of the main body 16 of the gun so as to be parallel to barrel axis 24, mounting of the sight 14 onto gun 10 by the above-described method, provides very accurate coplanar alignment of optical axis 34 with the barrel axis 24.

Figure 4B:
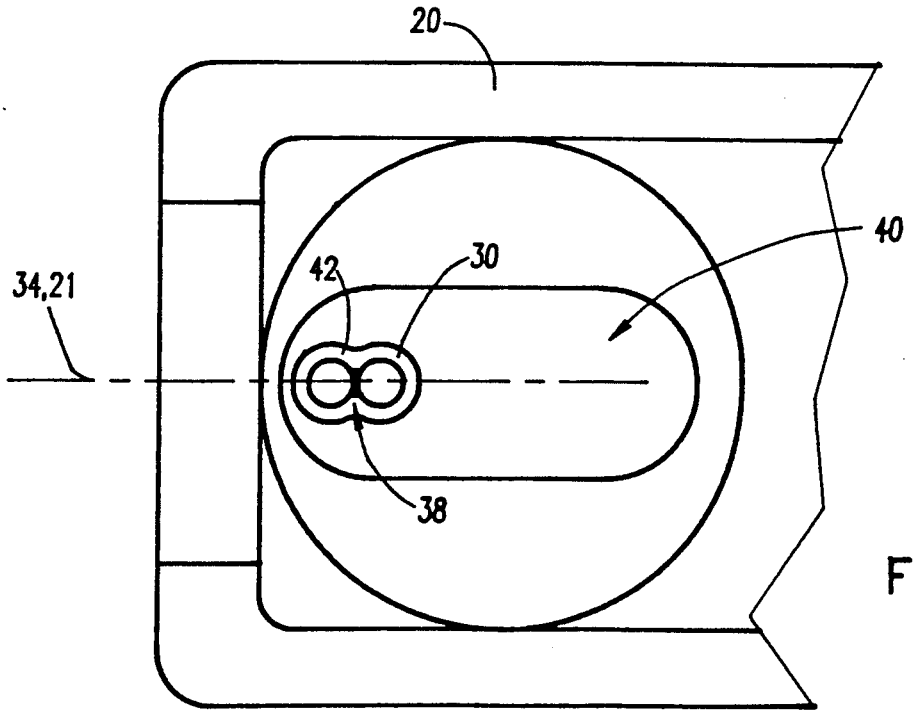
FIG. 4B is a bottom view illustration of the slide and sight of the invention, illustrating the configuration of the sight base after fastening, and taken in the direction of arrow 4B in FIG. 3D.

As shown in FIGS. 3B–4B, free-end portion 38 of base 30 defines, according to the present embodiment, typically a pair of generally cylindrical recesses, referenced 48 and 50, the respective ends define generally circular regions arranged for engagement by a suitable swaging tool having a primary swage head 52, so as to become flared portions 44 and 46 (FIGS. 3C, 3D and 4B). A secondary swage head 54 is typically provided in order to support sight 14 and slide 20 during swaging.

It will be appreciated by persons skilled in the art that, primary swage head 52 and secondary swage head 54 may form part of any conventional swaging apparatus such as a spring swage, or any other suitable swage.

According to the present embodiment, primary swage head 52 defines a pair of tapered, typically conical, primary head portions, referenced 56 and 58, which are configured for forced engagement with the recesses 48 and 50, so as to provide the above-described outward spreading or flaring thereof. It will be appreciated that as primary head portions 56 and 58 are forced, toward top portion 28 of the sight 14, radial force components are applied to side wall 42 in a generally outward direction, thereby causing the described spreading of the side wall 42, so as to result in the flared portions 44 and 46.

Although in the present example, wherein a dual headed swaging tool is employed, the swaging of both of recesses 48 and 50 is performed simultaneously, according to an alternative embodiment of the invention, each recess may be swaged separately, by a suitably configured single headed swaging tool.

Additionally, although recesses 48 and 50 are shown and described as being specifically cylindrical, in alternative embodiments, base 30 may define recessed regions of any suitable shape, for swaging by means of a suitably configured swaging tool.

Furthermore, although side wall 42 is shown and described herein as being continuous, it is envisaged that any two or more spaced apart, opposing leg portions, could be provided so as to constitute free-end portion 38 of side wall 42, and which, when swaged as described above, would be spread outwardly in opposing directions, so as to constitute flared portions 44 and 46, thereby securing sight 14 in a position of fixed parallel alignment with slot 36 and, therefore, with barrel axis 24.

It will be appreciated by persons skilled in the art that, the scope of the present invention is not limited by what has been particularly shown and described hereinabove. The scope of the invention is limited, rather, solely by the claims, which follow.

I claim:

1. A gun comprising:

a main body including a barrel and defining an elongate opening; and a sight mounted onto said main body, and including:

a top portion which protrudes externally of said main body and which defines a rearward facing front planar surface and an optical axis extending transversely thereto and in generally coplanar registration with the longitudinal axis of said barrel; and base means rigidly connected to and extending from said top portion and into said elongate opening arranged in said main body, wherein said base means has a free end portion which has an external configuration generally similar to that of said elongate opening, and which further has formed therein a recess surrounded by a side wall which extends through said opening so as to protrude beyond an inward-facing surface of said main body, and wherein at least two non-adjacent portions of said side wall are flared equally in respective radially outward directions so as to tightly engage said opening and said inward-facing surface of said main body, thereby to rigidly connect said sight to said main body and as to retain said optical axis in coplanar registration with the longitudinal axis of said barrel.

2. A gun according to claim 1, and wherein said elongate opening is a slot.

3. A gun according to claim 1, and wherein said gun is a handgun and said main body also comprises a slide, said sight being a front sight secured to said main body via an opening arranged in said slide.

4. A gun according to claim 3, and wherein said elongate opening has a longitudinal axis parallel to an axis of symmetry of said slide.

5. A gun according to claim 1, and wherein said sight is a front sight.

6. A gun according to claim 1, and wherein said sight is an illuminated sight.

7. A method of simultaneously fastening a sight onto a gun which has a barrel and optically aligning the sight with a longitudinal axis of the barrel, wherein the gun also has an elongate opening having a predetermined position relative to the longitudinal axis of the barrel, wherein the sight has a top portion which defines an optical axis, and a base whose external configuration is similar to the configuration of said opening and which has a free end whereat a side wall extends from the top portion so as to define a recess, and wherein said method comprises the following steps:

inserting the base of the sight into the opening such that the top portion of the sight rests on an outward-facing surface of the gun and such that the base is arranged within the opening; and simultaneously applying equal forces to at least two non-adjacent portions of the side wall of the base in respective, radially outward directions so as to cause the non-adjacent portions of the side wall to spread outward equally so as to bring the sight into a predetermined position relative to the main body of the gun whereat the optical axis of the top portion of the sight is in coplanar registration with the longitudinal axis of the barrel, and so as also to cause the side wall to become tightly engaged with the opening so as to lock the sight in said predetermined position.

8. A method according to claim 7, and wherein said step of simultaneously applying comprises the step of forcing a swage head portion, having a generally tapered configuration, into the recess defined at the free end of the base toward the top portion thereof, thereby forcing the side wall to spread in radially outward directions.

9. A method according to claim 8, and wherein the recess comprises at least two generally cylindrical recessed portions each defining a generally circular wall portion arranged for engagement by the swage head portion, and wherein said step of simultaneously applying comprises the following sub-steps:

simultaneously applying a uniform force in radially outward directions to a first one of the generally circular wall portions as to cause generally radial, outward bending thereof and thereby to cause tight engagement thereof with a first portion of the opening; and simultaneously applying a uniform force in radially outward directions to the other of the generally circular wall portions so as to cause generally radial, outward bending thereof and thereby to cause tight engagement thereof with a second portion of the opening.

10. A method according to claim 7, and wherein said method is a method of fastening a sight onto a handgun having a slide in which is formed an elongate opening, and said step of inserting comprises the step of inserting the base of the sight into the opening formed in the slide.

11. A method of simultaneously fastening an illuminated sight onto a gun which has a barrel and optically aligning the sight with a longitudinal axis of the barrel, wherein the gun also has an elongate opening having a predetermined position relative to the longitudinal axis of the barrel, wherein the sight has a top portion housing a radioluminous light source which defines an optical axis, and a base whose external configuration is similar to that of the opening, wherein the base defines a free end whereat a side wall extends from the top portion so as to define a recess, and wherein said method comprises the following steps:

inserting the base of the sight into the opening such that the top portion of the sight rests on an outward-facing surface of the gun and such that the base is arranged within the opening; and simultaneously applying equal forces to at least two non-adjacent portions of the side wall of the base in respective, radially outward directions so as to cause the non-adjacent portions of the side wall to spread outward equally so as to bring the sight into a predetermined position relative to the main body of the gun whereat the optical axis of the top portion of the sight is in coplanar registration with the longitudinal axis of the barrel, and so as also to cause the side wall to become tightly engaged with the opening so as to lock the sight in said predetermined position.

* * * * *